United States Patent [19]

Nakamura

[11] Patent Number: 4,555,840

[45] Date of Patent: Dec. 3, 1985

[54] PROCESS FOR POSITIONING AND ALIGNING DIES

[75] Inventor: Iwao Nakamura, Mobara, Japan

[73] Assignee: Futaba Denshi Kogyo K.K., Mobara, Japan

[21] Appl. No.: 480,283

[22] Filed: Mar. 30, 1983

Related U.S. Application Data

[62] Division of Ser. No. 211,850, Dec. 1, 1980, Pat. No. 4,397,094.

[30] Foreign Application Priority Data

Dec. 1, 1979 [JP] Japan ..... 54-154985

[51] Int. Cl.[4] ..... B23Q 3/00

[52] U.S. Cl. ..... 29/465; 29/271; 76/107 R

[58] Field of Search ..... 29/465, 271, 568; 76/107; 33/181 R, 180 R, 185 R

[56] References Cited

U.S. PATENT DOCUMENTS

| | | | |
|---|---|---|---|
| 1,995,711 | 3/1935 | Irmis | 29/465 |
| 2,089,795 | 8/1937 | Hodge | 29/465 |
| 2,325,290 | 7/1943 | Wales | 29/465 X |
| 3,126,776 | 3/1964 | Whistler, Sr. et al. | 29/465 UX |
| 3,386,781 | 6/1968 | Blazek et al. | 29/465 X |
| 3,504,576 | 4/1970 | Silberman et al. | 29/465 X |
| 3,540,314 | 11/1970 | Howard | 29/465 X |
| 3,554,060 | 1/1971 | Gargrave et al. | 29/465 X |
| 3,574,922 | 4/1971 | Eppich | 29/465 |

*Primary Examiner*—Charlie T. Moon

*Attorney, Agent, or Firm*—Oblon, Fisher, Spivak, McClelland & Maier

[57] ABSTRACT

A process and an apparatus for accurately locating and aligning dies on base plates is disclosed. The alignment of the dies is made by assembling a pair of the base plates in the form of a die set using jigs to be inserted into openings of the respective base plates for accurately aligning the base plate in vertically parallel relationship keeping space therebetween and for permitting the upper base plate to effect vertically reciprocal movement to accurately locate and align the dies with respect to the base plates. The apparatus comprises a pair of base plates and jigs for accurately aligning the base plates in vertically parallel relationship and for permitting the upper base plate to effect vertically reciprocal movement along the jigs to accurately locate and align the dies with respect to the base plates.

1 Claim, 7 Drawing Figures

PROCESS FOR POSITIONING AND ALIGNING DIES

This is a division of application Ser. No. 211,850, filed Dec. 1, 1980, now U.S. Pat. No. 4,397,094.

BACKGROUND OF THE INVENTION

1. Field of the Invention

This invention relates to a process and apparatus for accurately locating and aligning dies in a die changing apparatus.

2. Description of the Prior Art

Because of the recent increase in variety of products which can be produced by a press work operation and the short life cycle of the products, a variety of products are produced in a small quantity in actual factories. When several sorts of the products are produced in the small quantity by the press work operation, it is required to change dies mounted on the power press every time when a different type of the press work is conducted. This increases the percentage of preparatory press work operations, such as, for example, the mounting or exchanging operation of the die, in the overall press work operation, which results in a decrease in the working efficiency of the power press.

In order to shorten and simplify the preparatory operations, various die changing apparatuses which are generally referred to as a quick change fixture, and makes it possible to mount, exchange or align the dies on the power press for a short period of time have been proposed, and some of the apparatus have been actually put to practical use.

One example of this type of the die changing apparatus is disclosed in the Japanese Patent Publication No. 46-7668 wherein the positioning of dies is performed in such a manner that a base plate on which a die is mounted is inserted into a guide hole formed in a vertically movable slider, the slider is actuated in the vertical direction by means of a pneumatic or hydraulic driving means so as to clamp the base plate onto a mounting surface or the base plate, and guide pins projected from the mounting surface of the base plate are inserted into holes on the base plate.

Applicant has proposed a die changing apparatus which is simple in structure and easy to handle as shown in FIG. 1. The die changing apparatus shown in FIG. 1 comprises an upper die fixture 2 mounted for vertically reciprocal movement and a lower die fixture 3. The upper die fixture 2 is guided in its reciprocable vertical movement by spaced guide bushings which receive guide posts 1 respectively, mounted uprightly in the lower die fixture 3. The upper and the lower die fixtures are provided with a pair of mounting devices 5 having stoppers 4 which are of substantially L-shape in cross section. A die 6 is secured to a base plate 7 in a precise manner in reference to its companion die and the base plate 7 is slidably received within two grooves with the two of its opposite edges thereby mounted one within each of a pair of mounting devices 5. The base plates 7 are accurately located within the fixtures by forcing four locating pins 8 retracted in the upper and the lower die fixtures 2 and 3 to enter companion openings 9 in the base plates 7 by means of pneumatic, hydraulic or rack and pinion mechanisms. When using the die changing apparatus shown in FIG. 1, replacement and mounting of the base plate 7 securing the dies can be achieved in a single step, which makes it possible to simplify the die changing operation and to shorten the time required for the die changing operation.

In the die changing apparatus shown in FIG. 1, the operations for accurately positioning and aligning dies 6 with respect to the base plates 7 are performed before and after or during operation of the power press as preparatory work. In order to achieve this die aligning operation accurately, it is usual to use a special die set which is independent of the die changing apparatus. This die set is generally referred to as a die setter and includes a nonreciprocating lower die fixture and an upper die fixture mounted for vertically reciprocal movement in the direction of the lower die fixture. When positioning and aligning the upper and the lower dies 6, the base plates 7 are secured to each of the upper and the lower die fixtures and the upper die fixture is lowered to determine fixing positions of the upper and the lower dies with respect to the base plates 7 so that appropriate clearance may be created between the upper and the lower dies, and then the upper and the lower dies are secured in position to the base plates.

The upper and the lower die fixtures of the die setter are provided with locating pins which are accurately in alignment with the locating pins 8 of the upper and the lower die fixtures 2 and 3 of the die changing apparatus shown in FIG. 1, and the positioning of the base plates 7 with respect to the die setter is effected by entering the locating pins into openings of the base plates 7. Accordingly, if each of the locating pins 8 of the die changing apparatus is accurately in alignment with each of the locating pins of the die setter, the base plates 7 after completing the die aligning operation by means of the die setter can be mounted on the die changing apparatus shown in FIG. 1 keeping the clearance between the upper and the lower dies as accurately as it is decided by the die setter. However, as a matter of fact, it is extremely difficult to effect machineworks which permit each of the locating pins 8 of the die changing apparatus to accurately align with each of the locating pins of the die setter, and errors are inevitably created when the die setter is subjected to the machinework. Accordingly, even if the die alignment in the die setter is perfect, there is a possibility of offset of the dies arising due to the errors inherent in the die setter when the base plates 7 are mounted on the die changing apparatus, and it is extremely difficult to restrict the offset of the dies less than several $\mu$m. Furthermore, in the process for aligning the dies using the die setter explained hereinabove, it is necessary to use the die set in addition to the die changing apparatus, which increases die design cost and die manufacturing cost.

SUMMARY OF THE INVENTION

In view of the disadvantages of the prior art as explained hereinabove, this invention has been made on the basis of the findings that base plates used in a die changing apparatus include openings in accurately defined locations into which guide posts can be directly inserted. According to an aspect of the invention, a pair of the base plates are assembled in the form of a die set by inserting the guide posts into the openings, thereby permitting upper and lower dies to accurately position and align in the respective base plates.

The present invention has for one of its principal aims, the provisions of a novel process for positioning and aligning dies, to lower the die manufacturing cost and to reduce proportionately the production cost for manufacturing a particular item.

It is another object of the present invention to provide a process for positioning and aligning dies so that the dies can be accurately and speedily located and clamped in its operative position without requiring a die setter. In the process of positioning and aligning the dies, there is no offset of the dies mounted on the die changing apparatus resulting from errors inherent in the die setter and clearance between the upper and the lower dies can be maintained in high accuracy.

It is still another object of the present invention to provide a die aligning apparatus which accurately and readily disposes dies within the die changing apparatus.

Briefly, the foregoing and other objects are attained in accordance with an aspect of the present invention through the provision of a process for positioning and aligning dies secured to a pair of base plates having a plurality of openings corresponding to locating pins projected on a base of a die changing apparatus which comprises the steps of mounting guide posts uprightly on one of a pair of the base plates by inserting one end of the guide posts into openings of the base plate, mounting remaining base plate for vertically reciprocal movement on the guide post by inserting another and of the guide posts into openings of the base plate so that both base plates may be assembled in the form of a die set accurately aligning the openings provided in the respective base plates, and securing the dies to a pair of the base plates respectively which are assembled in the form of the die set accurately positioning and aligning each of the dies.

According to another aspect of the present invention, there is provided a die changing apparatus which comprises a pair of base plates having a plurality of openings corresponding to locating pins projected from a base of a die changing apparatus to which upper and lower dies are secured, at least two guide posts each having a stud portion at an end thereof to be inserted into the opening of one of a pair of the base plates and having guide portion at an opposite end thereof to be inserted into the opening of the remaining base plate for guiding vertically reciprocal movement on the guide post, the stud portion and the guide portion of the guide post being coaxially formed, and a means for fastening the guide post to the base plate so as to errect the guide post uprightly on the base plate.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference characters designates the same or similar parts throughout the figures thereof and wherein.

DETAILED DESCRIPTION OF THE PREFERRED EMBODIMENTS

A method and apparatus for aligning dies according to an embodiment of the present invention will be hereinafter described with reference to the accompanying drawings. To begin with, reference will be made to a base plate used in a die changing apparatus.

Figure 1:
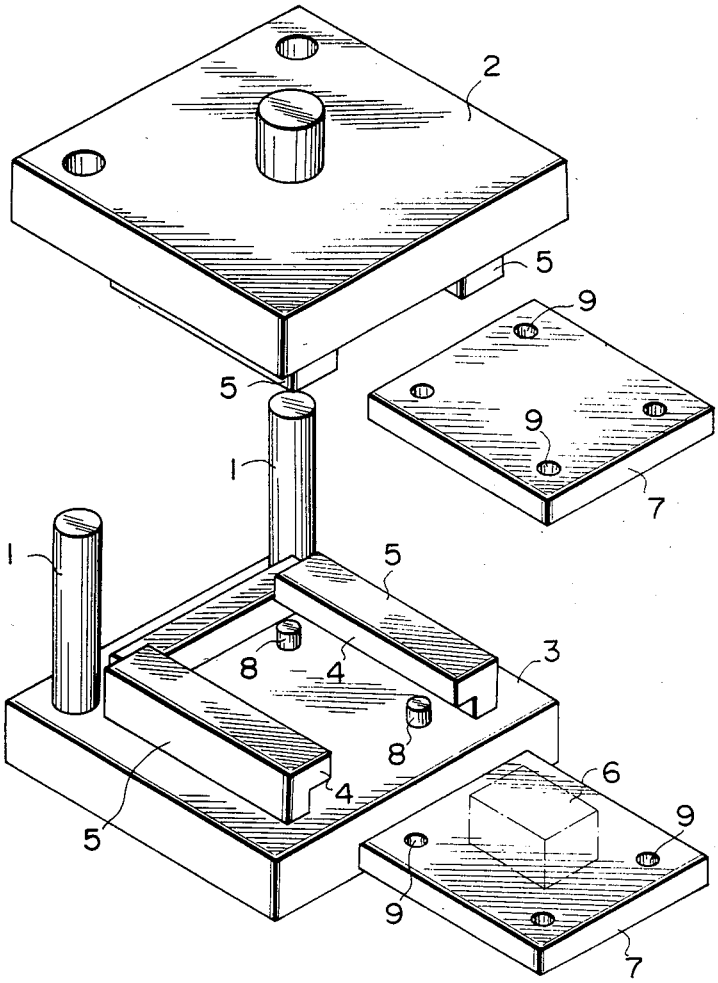
FIG. 1 is a exploded perspective view of a die changing apparatus.
Figure 2:
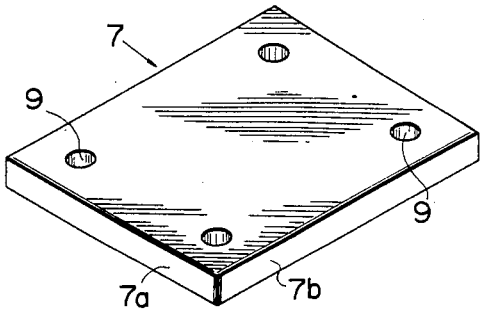
FIG. 2 is a perspective view of a base plate used in a die changing apparatus.

FIG. 2 shows the base plate used in the die changing apparatus, which is generally indicated by the reference numeral 7. The base plate 7 is standardized in its external dimension and thickness so that it may be slidably received within the mounting devices 5 of the die changing apparatus explained hereinabove in connection with FIG. 1. The vertical and longitudinal side surfaces 7*a* and 7*b* of the base plates 7 intersect at a right angle and provide two orthogonal reference planes for accurately locating and mounting dies or tools within the machine. The base plate 7 is provided with at least two openings 9 (four openings are shown in FIGS. 1 and 2) at the predetermined positions around the corners thereof strictly regulated from the orthogonal two reference planes 7*a* and 7*b*. The openings 9 have the same diameter as that of the locating pins 8 shown in FIG. 1 and are exactly in alignment with the pins 8 when the base plate 7 is mounted on the die changing apparatus. The base plate 7 thus constituted is prepared in requisite number so as to mount each die to be exchanged. The base plate 7 is constituted as explained hereinabove, thus, it can be accurately located in position on the upper die fixture 2 or the lower die fixture 3 whenever replacement and mounting of the base plate 7 in the die changing apparatus shown in FIG. 1 is repeated.

Figure 3:
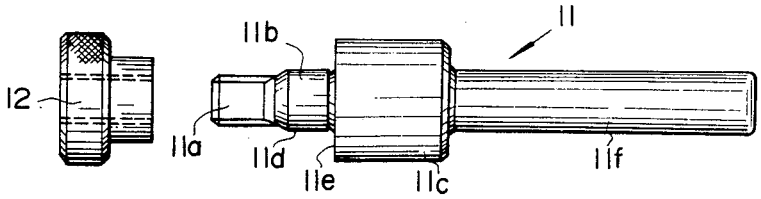
FIG. 3 is a plan view of a jig used in a die aligning apparatus according to the present invention.

Referring now to FIG. 3 which shows a die aligning apparatus for assembling the base plates 7 into a die set to effect an alignment of the die according to the present invention, the die aligning apparatus comprises a guide post 11 to be used as a jig for assembling the base plates and a clamp nut 12 for securing the guide post 11 to be mounted uprightly on one of a pair of the base plates to which upper and lower dies are fixed. The guide post 11 is provided with a threaded portion 11*a* at an end thereof on which the clamp nut 12 is screwed and a stud portion 11*b* to be inserted into the opening 9 of the base plate 7 shown in FIG. 2.

The stud portion 11*b* is columnar in shape having the outer diameter substantially equal to the inner diameter of the opening 9 so that it may be fitted in the opening 9 without clearance. The guide post 11 further includes a columnar flange 11*c* which is formed next to the stud portion 11*b* so as to clamp the base plate 7 with the clamp nut 12 when the guide post 11 is erected in the opening 9 of the base plate 7. In order to mount the guide post 11 uprightly upon the base plate 7, the circumference 11*d* of the stud portion 11*b* is formed so as to intersect angle at a right angle the surface 11*e* of the columnar flange 11*c* to which the base plate 7 is contacted. Reference numeral 11*f* is a guide portion having the same diameter and central axis as those of the stud portion 11*b*, namely, the outer diameter is substantially equal to the inner diameter of the opening 9 of the base plate 7.

As explained hereinabove, in the die aligning apparatus according to the present invention, a pair of the base plates to which the dies are fixed is assembled in the shape of the die set by using the guide posts having the columnar portions at the longitudinal ends thereof which are coaxial and the same diameter so as to be inserted into the openings of the base plate 7 without clearance.

Reference will be made to the die aligning apparatus for assembling a pair of the base plates 7 into the die set by using the jigs in connection with FIGS. 4 and 5.

Figure 4:
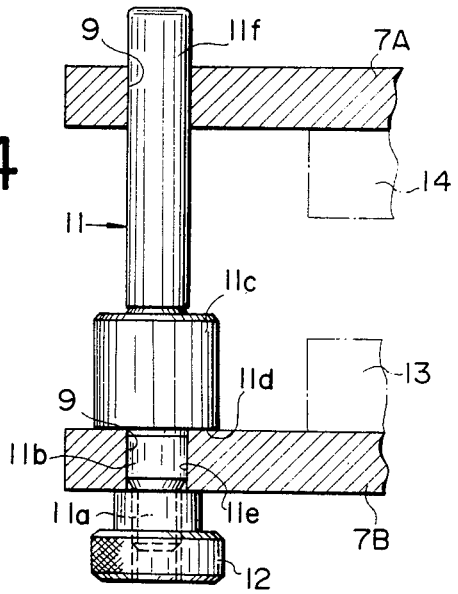
FIG. 4 is a fragmentary vertical side elevational view of a die aligning apparatus according to an embodiment of the present invention illustrating how to assemble a pair of base plates into a die set using the jig shown in FIG. 3.
Figure 5:
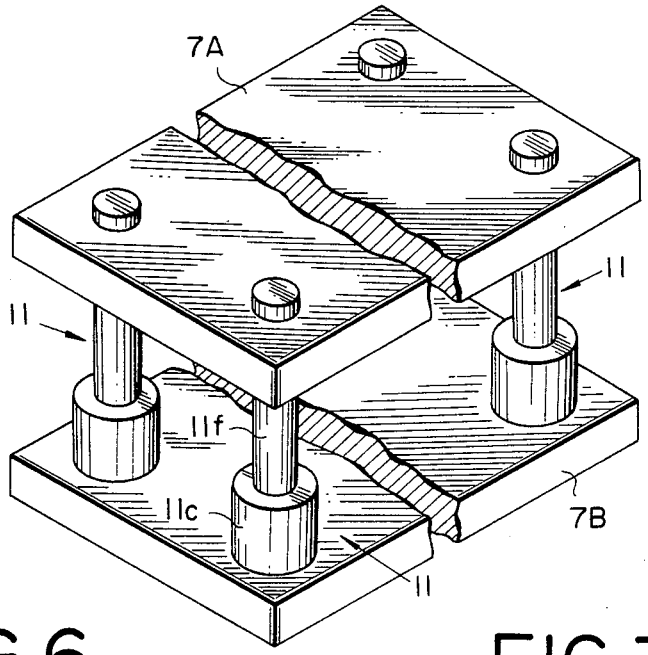
FIG. 5 is a partially cut away perspective view of overall assembly of a die aligning apparatus according to the present invention.

FIG. 4 is a fragmentary vertical side elevational view of the die aligning apparatus in which a pair of the base plates 7 are assembled into the die set by using the jigs shown in FIG. 3, and FIG. 5 is a perspective view of the overall assembly of the die set.

When assembling the base plates 7 into the die set, a pair of the base plates 7A and 7B for fixing the upper and lower dies and at least two guide posts 11 (four guide posts are used in the embodiment shown in FIG. 5) for aligning the base plates 7A and 7B are prepared. Then, the guide post 11 is mounted uprightly on the base plate 7B by inserting the stud portion **11*b* of the guide post 11 into the opening 9 of the base plate 7B, and is clamped and secured to the base plate 7B by screwing the clamp nut 12 onto the threaded portion 11*a* projected from the under surface of the base plate 7B as shown in FIG. 4. The guide post 11 is mounted uprightly on the base plate 7B, because the circumference 11*d* of the stud portion 11*b* of the guide post 11 and the surface 11*e* of the columnar flange 11*c* intersect at a right angle. The base plate 7A is then slidably mounted on the guide post 11 erected on the base plate 7B by putting the guide portion 11*f* of the guide post 11 into the opening 9 of the base plate 7A, thereby completing the assembly of a pair of the base plates 7A and 7B in the form of the die set. When the base plates 7A and 7B are assembled, the openings 9 in each of the base plates are exactly in alignment, because the stud portion 11*b* and the guide portion 11*f* of the guide post 11 are concentric and the same diameter, and the vertical movement of the base plate 7A is guided by the guide portion 11*f* of the guide post 11 keeping the exact cocentric relationship with the respective openings 9 of the base plates 7A and 7B. In this state, upper and lower dies 14 and 13 are fixed to the base plates 7A and 7B, respectively, having appropriate clearance therebetween after deciding fixing positions of the upper and lower dies with respect to the base plates 7A and 7B**. Then, the die aligning operation is completed.

In an alternate embodiment of the present invention, spacers having suitable height may be disposed between the base plates 7A and 7B depending upon the height of the upper and lower dies 14 and 13 or coil springs having suitable tension may be wound around the guide posts 11 so that the opposed space between the base plates 7A and 7B may be regulated in the predetermined value to simplify the die aligning operation.

After the alignment of the dies 13 and 14, the base plate 7A is pulled out of the guide portion **11*f* of the guide post 11 and the guide post 11 is disengaged from the base plate 7*b* by unscrewing the clamp nut 12 from the threaded portion 11*a*. Then, a pair of the base plates 7A and 7B having the upper and lower dies 14 and 13 accurately aligned and fixed to the respective surfaces of the base plates are obtained. When the base plates 7A and 7B which are aligned as explained hereinabove are mounted on the die changing apparatus shown in FIG. 1, there may be caused an offset of the dies which is resulted from misalignment of the guide pins projected downwardly from the upper fixture 2 with the guide pins 8 projected upwardly from the lower fixture 3**. However, it is easy to maintain errors to be produced in machine works of the die changing apparatus less than several μm by subjecting the machine to a precision finishing. Accordingly, in the method of the present invention, the misalignment of the dies can be less than several μm.

To the contrary, in the conventional method of aligning the dies using a die setter, the die setter includes machining errors as well as the die changing apparatus. These errors cause the offset of the dies. When aligning the dies using the conventional die setter, the offset of the dies is magnified by the misalignment of the guide pins provided on the die changing apparatus and die setter and the misalignment of the guide pins provided on the upper and lower fixtures of the die setter. Accordingly, it is extremely difficult to keep the offset of the dies less than several μm when the base plates are mounted on the die changing apparatus after completing the alignment of the base plates.

To the contrary, in the present invention, the minor offset of the dies can be recognized after mounting the base plates on the die changing apparatus, which permits precision power press operation having the offset of less than several μm. In addition, a pair of the base plates can be assembled to form the die aligning apparatus by using the simple jigs, and the die setter can be dispensed. Therefore, the cost requiring for the die changing system can be significantly reduced. Furthermore, in the present invention, the upper base plate corresponds to the upper die fixture of the die setter and can effect vertically reciprocal movement with respect to the lower base plate with less labor at the time of aligning the dies. This is a remarkable contrast to the conventional method for aligning the dies which is effected by moving the upper die fixture of the die setter fixing the base plate upwardly and downwardly with respect to the lower fixture of the die setter.

Figure 6:
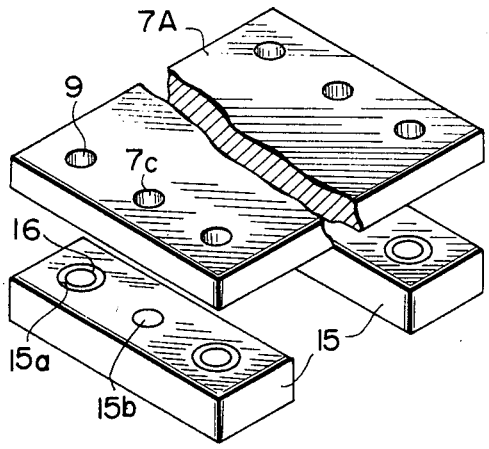
FIG. 6 is a partially cut away exploded perspective view of a base plate used in a die changing apparatus according to another embodiment of the present invention.
Figure 7:
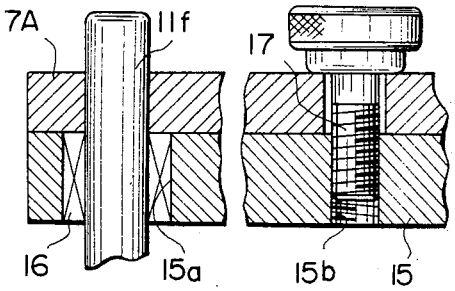
FIG. 7 is a fragmentary vertical sectional view of the base plate shown in FIG. 6 illustrating how it is mounted on a jig to form a die set.

In the embodiment explained hereinabove, the guide portion **11*f* of the guide post 11 is directly inserted into the opening 9 of the base plate 7. However, if the thickness of the base plate is thin, the vertical reciprocating movement of the base plate can not be effected smoothly. In this case, guide blocks 15 may be fixed to the base plate 7A as shown in FIGS. 6 and 7. The guide blocks 15 are provided with openings 15*a* which are coaxial with the openings 9 of the base plate 7, bushes 16, as for example, linear ball bearings, having the same inner diameter as that of the openings which are press-fitted into the openings 9, and screw holes 15*b*. The base plate 7A includes through holes 7*c* which are coaxial with the screw holes 15*b*. When the base plate 7A and the guide block 15 are assembled in superposed relationship as shown in FIG. 7 and clamped by a clamp bolt 17, the combined base plate 7A and the guide block 15 provides wider guide surfaces along which the guide portion 11*f* of the guide post 11 slides, thereby making it possible for the thinner base plate 7A** to effect smooth vertical reciprocating movement along the guide post.

As explained hereinabove, in the method and apparatus for aligning the dies according to the present invention, the alignment of the dies is effected by assembling the base plates fixing and securing the upper and the lower dies thereto in the form of the die set using the guide openings which are accurately located in the respective base plates. Accordingly, the alignment of the dies effected by the present invention is free from the errors inherent in the die setter to be imparted when the dies are aligned by using the die setter and the offset of the dies can be hardly recognized when the base plate is mounted within the die changing apparatus. Thus, the precision power press operation can be effected in the present invention. In addition, the die aligning apparatus of the present invention does not require the relatively heavy die setter and is capable of effecting the high precision die aligning operation by using the jigs of simple structure. Therefore, working efficiency of the die alignment operation can be significantly improved and cost requiring for constituting the die changing system can be remarkably reduced, which, in turn, reduces proportionately the production cost for manufacturing a particular item.

Obviously, many modifications and variations of the present invention are possible in the light of the above teachings. It is therefore to be understood that within the scope of the appended claims, the invention may be practiced otherwise than as specifically described.

What is claimed as new and desired to be secured by letters patent of the United States is:

1. A process for accurately locating and aligning dies with respect to a pair of upper and lower die fixtures having locating pins, said process comprising the steps of:

uprightly mounting guide posts in openings of one of a pair of base plates by inserting ends of the guide posts into said openings of the base plate, said openings of said one base plate being positioned such that said locating pins of one of said die fixtures fit therein when said one of said base plates is mounted thereon;

mounting a remaining one of said pair of the base plates for vertically reciprocal movement on the uprightly erected guide posts by slidably inserting the other ends of said guide posts into openings of said remaining base plate of said pair of base plates, thereby assembling a pair of the base plates in the form of a die set accurately aligning the openings of the respective base plates, said openings of said remaining base plate being positioned such that said locating pins of another of said die fixtures fit therein when said remaining base plate is mounted thereon;

locating said dies in said pair of said base plates assembled in the form of said die set for accurately aligning each of the dies, and securing said dies to respective ones of said base plates in defined locations thereof;

mounting said one base plate to said one die fixture with said pins of said one die fixture inserted in said holes of said one base plate; and mounting said remaining base plate to said another die fixture with said pins of said another die fixture inserted in said holes of said remaining base plate.

* * * * *